US009115530B2

(12) United States Patent
Michael et al.

(10) Patent No.: US 9,115,530 B2
(45) Date of Patent: Aug. 25, 2015

(54) STEP AND PULL SANITARY DOOR OPENER

(75) Inventors: Sewell Michael, Springfield, MO (US); Kelly Coddington, Fair Grove, MO (US); Ron Ely, Nixa, MO (US)

(73) Assignee: KRM Innovations, Inc., Springfield, MO (US)

( * ) Notice: Subject to any disclaimer, the term of this patent is extended or adjusted under 35 U.S.C. 154(b) by 748 days.

(21) Appl. No.: 12/313,933

(22) Filed: Nov. 26, 2008

(65) Prior Publication Data

US 2009/0145037 A1 Jun. 11, 2009

Related U.S. Application Data

(60) Provisional application No. 61/004,550, filed on Nov. 28, 2007.

(51) Int. Cl.

| | |
|---|---|
| ***E05C 19/18*** | (2006.01) |
| ***E05F 11/54*** | (2006.01) |
| ***E05C 17/50*** | (2006.01) |
| *A45C 13/26* | (2006.01) |
| *E05B 53/00* | (2006.01) |

(52) U.S. Cl.

CPC ..... *E05F 11/54* (2013.01); *E05C 17/50* (2013.01); *E05B 53/001* (2013.01)

(58) Field of Classification Search

USPC ..... 292/288, DIG. 15; 16/412, 413, 422, 16/904

See application file for complete search history.

(56) References Cited

U.S. PATENT DOCUMENTS

| | | | | | |
|---|---|---|---|---|---|
| 1,244,910 | A | * | 10/1917 | Smith | 292/341.15 |
| 1,337,384 | A | * | 4/1920 | Allen | 16/412 |
| 1,552,462 | A | * | 9/1925 | Bailey | 292/255 |
| 2,042,297 | A | * | 5/1936 | Craighead | 292/87 |
| 2,120,534 | A | * | 6/1938 | Wild | 292/255 |
| 3,391,674 | A | * | 7/1968 | Burleigh | 119/174 |
| 4,068,872 | A | * | 1/1978 | Smith | 292/87 |
| 4,569,546 | A | * | 2/1986 | Howard et al. | 292/336.3 |
| 4,621,848 | A | * | 11/1986 | Pierce | 292/336.3 |
| D296,189 | S | * | 6/1988 | Marx | D8/400 |
| 5,193,863 | A | * | 3/1993 | McBain | 292/255 |
| 5,983,454 | A | * | 11/1999 | Hartselle, III | 16/412 |
| 6,189,183 | B1 | * | 2/2001 | Hartselle, III | 16/412 |
| 6,328,392 | B1 | * | 12/2001 | Whitcomb | 312/319.9 |
| 6,938,376 | B2 | * | 9/2005 | Youssef | 49/394 |
| 7,043,799 | B2 | * | 5/2006 | Moody | 16/412 |
| D595,560 | S | * | 7/2009 | Miska | D8/314 |
| 7,717,068 | B2 | * | 5/2010 | Wilson | 119/712 |
| 2003/0001471 | A1 | | 1/2003 | Libby et al. | |
| 2005/0005402 | A1 | * | 1/2005 | Moody | 16/413 |

FOREIGN PATENT DOCUMENTS

| | | | |
|---|---|---|---|
| CN | 201513056 | * | 6/2010 |

* cited by examiner

*Primary Examiner* — Carlos Lugo
(74) *Attorney, Agent, or Firm* — Lathrop & Gage LLP

(57) ABSTRACT

A door opener for mounting on a door, including a mounting plate, a frictional engagement beam and an upwardly projecting ledge spaced apart from the mounting plate. A user steps onto the device contacting their shoe with the engagement bar and the upwardly projecting ledge to frictionally engage the shoe to the opener. The user then forcibly retracts their foot towards their body to lever the door open.

13 Claims, 6 Drawing Sheets

STEP AND PULL SANITARY DOOR OPENER

CROSS-REFERENCE TO RELATED APPLICATIONS

The application claims the benefit of U.S. Provisional Application No. 61/004,550, filed Nov. 28, 2007, the disclosure of which is incorporated by reference.

BACKGROUND OF THE INVENTION

The present invention relates to a door opener, which allows a user to open an inward swinging door utilizing their foot by stepping onto the opener, applying downward pressure for frictional engagement of the device and retracting their foot toward their body to pull the door open.

Doors are a common every day occurrence in houses, businesses and public venues. Doors are typically opened and closed with knobs, handles and pulls, which are well known in the art. Doors, and their associated opening mechanisms, are generally configured for operation by a user's hand, by either grasping and pulling or grasping and pushing. There are common occurrences, however, when utilizing one's hand to open or close a door is undesirable. For example, individuals with physical limitations may find it difficult to pull open a door utilizing a conventional knob or grasp handle. Individual's whose arms are frequently full, transporting a load or carrying objects, may often find it difficult to grasp and pull a knob or handle.

Further, it is generally undesirable to touch a doorknob or grasp with one's hand, particularly in settings where the handle or pull may be dirty or contaminated, such as in public restrooms. It is known and documented that a majority of individuals using public restrooms take precautionary measures to avoid skin contact with the restroom door upon exiting. For example, users will often use a paper towel to shield their hand when operating door hardware upon exiting a restroom. This fact is evident in the common placement of trash receptacles near public restroom doors for deposit of paper towels once the user has opened the door. When paper towels are not available, such as in restrooms only offering hand air dryers, users creatively manipulate inward swinging doors by shielding their hands with their clothing, kicking the door to "bounce" it open, or even waiting until someone else opens the door.

Efforts have been made to assist users in opening doors. There are many known types of door openers, including complex electrical mechanical apparatuses used on handicap accessible doors, pneumatic openers, hydraulic openers and the like. What is needed is a simple mechanical device, inexpensive to manufacture, easy to install and easy to use. For the most part, devices intended to assist a user in opening a door are expensive, cumbersome, prone to malfunction and easy to damage. Moreover, improper maintenance of complex door opening devices may result in user injury, damage to the door or door frame, and in some instances may prevent the door from being opened.

One effort to develop a simple mechanical device for opening a door is disclosed in U.S. Patent Application 20050005402 for a "Sanitary Door Opener" filed by Charles Moody. The Moody Application discloses a simple mechanical door pull, mounted near the bottom of a door. The pull is similar to a bin handle, commonly found on cabinetry, and is configured to allow the user to engage the pull with the toe of their shoe. The toe of the user's shoe is positioned under the pull into a concavity. The toe of the shoe engages the pull and the user retracts their leg swinging the door towards themselves. There are several obvious and inherent problems with this design. First, it requires the user to balance themselves on one leg while positioning the toe of their shoe under the pull. The user must then continue to balance themselves while retracting the leg. As the door is opened, the user may have to hop backwards to allow the door to swing wide enough to access. Another flaw with this design is that some users may have open-toed shoes, such as sandals, flip-flops, or open-toed dress shoes. When the user's toes are inserted into the device, the upper surface of their foot may be abraded, cut or injured. Moreover, dust, dirt and grime may build up inside of the device, which will transfer to the user's shoe, or foot.

SUMMARY OF THE INVENTION

The instant invention is configured to overcome the stated flaws of the known art. The instant invention is preferably manufactured from a single piece of rigid material such as aluminum or stainless steel. It is fastened to a door near the lower edge of the inner door surface using simple mechanical fasteners. The device has a frictional engagement bar which is contacted by a user's foot. The user engages the device by placing their foot onto the upper surface of the frictional engagement bar and stepping downward to apply force. As the force is increased, the frictional co-efficient between the user's shoe and the device is also increased. The user then can physically draw their foot backwards in the general direction of their body which in turn pulls the door toward their body into an open position. Because the user's foot is on top of the device engaging the frictional engagement bar it can be easily and quickly removed so that the user does not have to balance on one foot or hop backwards as the door opens.

The general preferred design can be mounted to virtually any door, of any manufacture, composition and size. Several different device configurations may be better suited to specific door applications. For example, inexpensive hollow core doors are prone to breaking during hard use. The device may include an integral U-shaped mounting bracket which is placed at the bottom edge of the door to further support the door during use. This bracket configuration reduces the likelihood that the door will break when the device is used. The U-shaped bracket may also cover the edge of the door for further stabilization of the door during use. This configuration generally increases the aesthetic appeal of the device when installed.

The device is sanitary because all contact surfaces can be easily cleaned and none of the surfaces are hidden, recessed or shielded. Because only the sole of the user's shoe contacts the device, no scraping, abrasion or similar damage is imparted to the shoe upper or the user's foot. The device is easy to manufacture, easy to install and can readily be replaced as needed. Further, the device is unique in that it allows a user's natural stepping motion to engage the device for operation. It does not require the user to unduly balance themselves, hold onto an adjacent wall or take any unusual or extraneous movements to operate. Once the user has engaged the device, a quick pulling motion with the foot is all it takes to open the door.

When desired, the inventive device can be coupled with a latch mechanism which allows the door to be selectively maintained in the open position. Generally, the latch mechanism is fastened to a wall near the door, or in some applications may be fastened to the floor. When the door is fully opened, the latching mechanism is actuated to engage the device thereby maintaining the door in the open position. A variety of mounting mechanisms can be used to secure the device to the door. Further, a variety of designs, shapes and sizes can be utilized without departing from the spirit and scope of the invention.

DETAILED DESCRIPTION OF THE INVENTION

Figure 1:
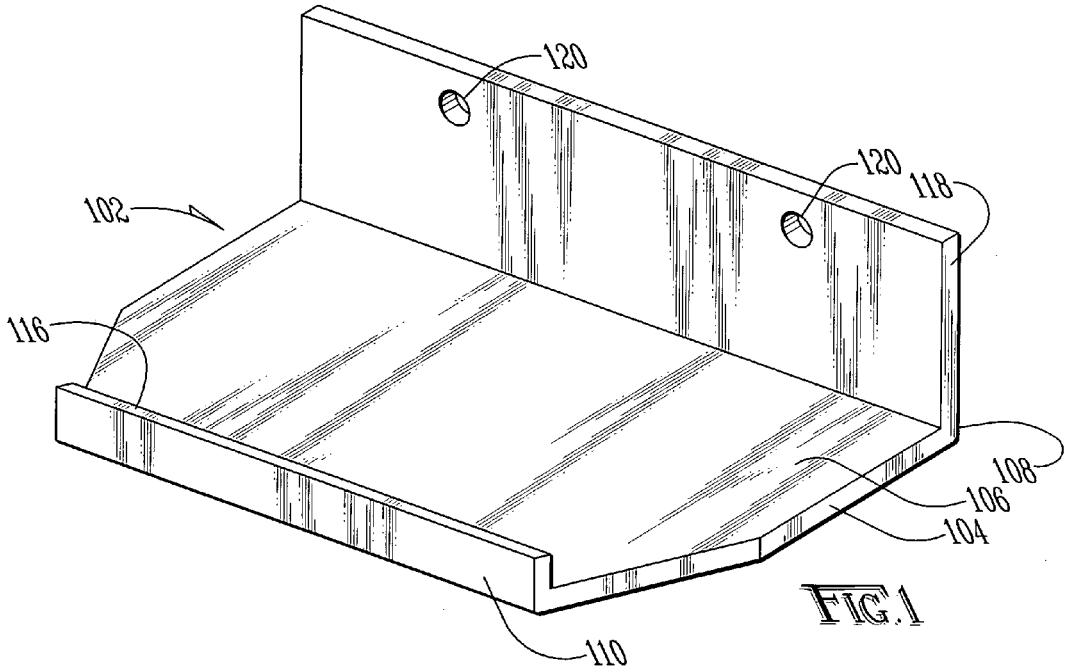
FIG. 1 is a perspective view of one embodiment of the device.
Figure 2:
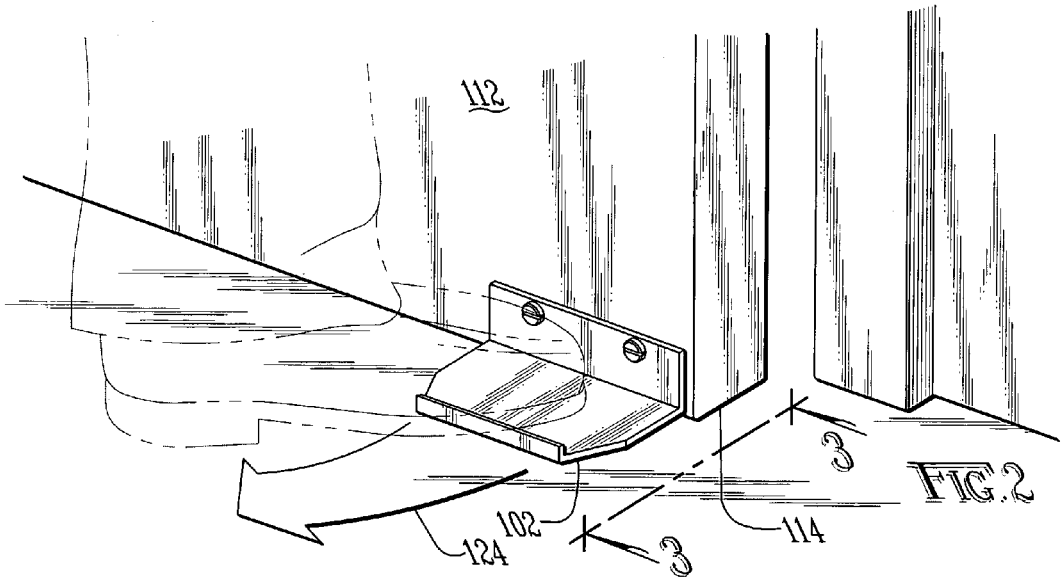
FIG. 2 is a second perspective view of the device installed and in use.
Figure 3:
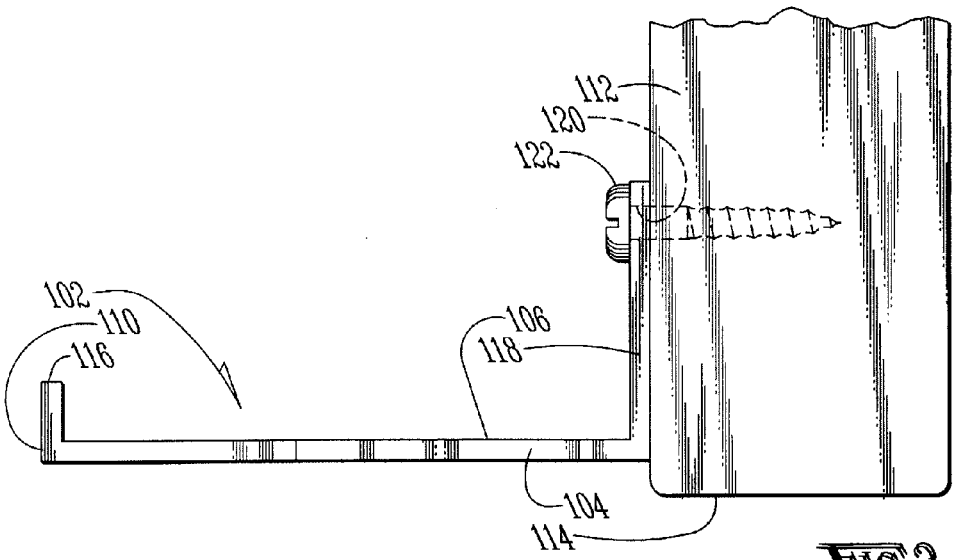
FIG. 3 is a side view of the device taken along line 3-3 of FIG. 2.

The present invention is to a door opener that can be engaged by a user's foot for forcibly pulling open a hinged door. Referring now generally to the drawings, a door-opening device intended for attachment to a hinged door is shown. The device, as shown in FIGS. 1-3 is attached near the lower edge of the inner surface of an inwardly swinging hinged door. The door opener 102 is formed from rigid material such as aluminum, steel, stainless steel or plastic. The opener 102 includes a beam 104, an upper surface 106, an opposed lower surface (not shown), an inner edge 108 and a spaced apart outer edge 110. The device 102 is fastened to the inner surface of an inwardly swinging door 112 adjacent a lower edge 114, with the beam 104 projecting generally perpendicular to the inner surface of the door 112. The outer edge 110 is spaced apart from the inner edge 108 and is maintained generally perpendicular to the door surface. At the outer edge 110, an upward-turned ledge 116 is formed. It is preferred that the ledge 116 span substantially the entire length of the device 102 but it can be manufactured in any length, height or dimension. A mounting plate 118 is preferably fixed to the inner edge 108 for fastening the device 102 to the door 112. The mounting plate 118 includes fastening bores 120 for the receipt and securement of conventional fasteners 122 such as screws or bolts.

It is also preferable that the device 112 be manufactured from a unitary piece of material, such as aluminum, steel, stainless steel or plastic. It is understood, however, that the device could be manufactured virtually in any metal, a variety of plastics, carbon fibers, fiberglass or similar rigid materials.

To use the device 102, the user faces the inner surface of the inwardly swinging door 112 then steps forward to place the sole of the shoe of their leading leg, downward and forcibly onto the upper surface 106 and ledge 116 of the device 102 as best shown in FIG. 2. As the user shifts their weight forward in a normal stepping manner, the sole of their shoe frictionally engages the upper surface 106 and ledge 116 of the device 102. When the user has shifted enough of their weight forward onto the device 102, they then retract their leg in a rearward motion, thereby causing the door 112 to move inward toward their body in the direction of arrow 124. As the door 112 swings toward their body, they simply lift their foot off the device 102 and pass through the open door. Thusly, the user does not have to engage any portion of the door 112 with their hand or arm. This is particularly advantageous in situations where the user of the door typically has their arms full, is physically unable to utilize their arms and hands to open the door, or in situations where contacting the door could be unsanitary or undesirable.

Figure 4:
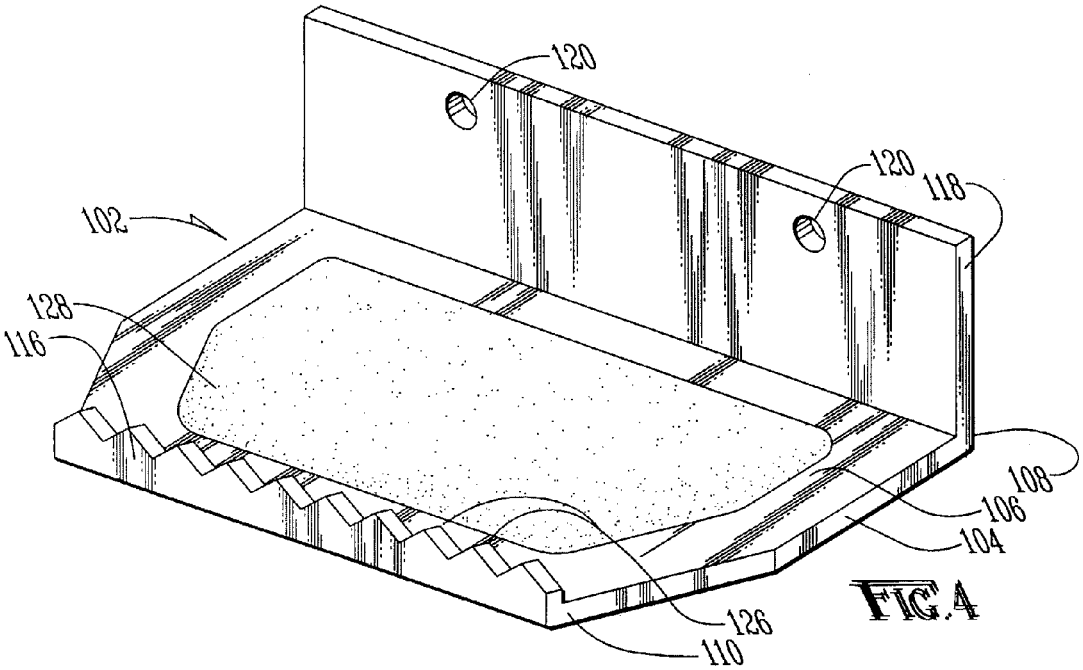
FIG. 4 is a perspective view of a second embodiment of the inventive device.
Figure 3A:
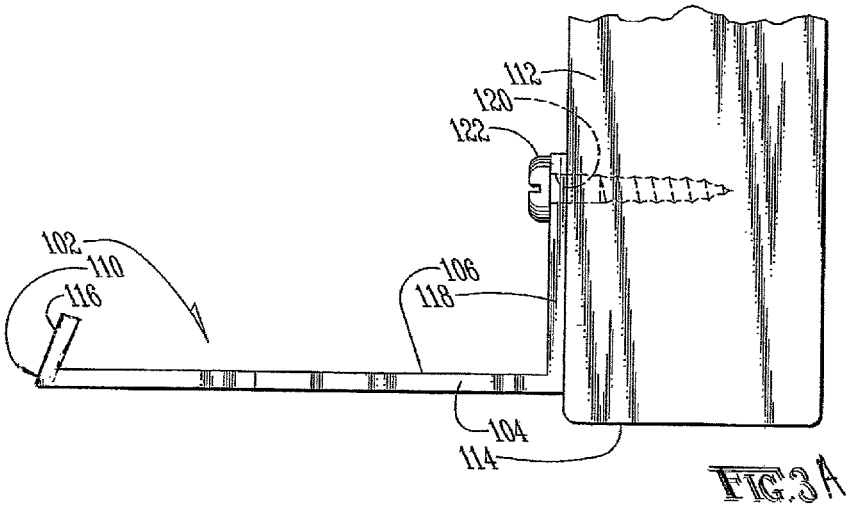
FIG. 3A is a side view of the device in another embodiment.

It may be desirable to increase the frictional co-efficient between the user's shoe and the device 102. Accordingly, the upper surface 106, the ledge 116 or both can be altered to increase the adhesion between the shoe and the device 102. As shown in FIG. 4, the upward turned ledge 116 may have a profile 124. This profile 126 can be scalloped, beaded, beveled, serrated or take on any other similar pattern, which attributes to the usability of the device 102 as more particularly described below. Further, the ledge may be angled slightly inboard towards the door's surface to increase the grasp ability of the ledge by the user's shoe as shown in FIG. 3A. This may also include covering the upper surface 106 or the ledge 116 with an abrasive 128 which could be formed rubber, adhesive material, foam, any skid or slip resistant covering, epoxies and the like.

Figure 5:
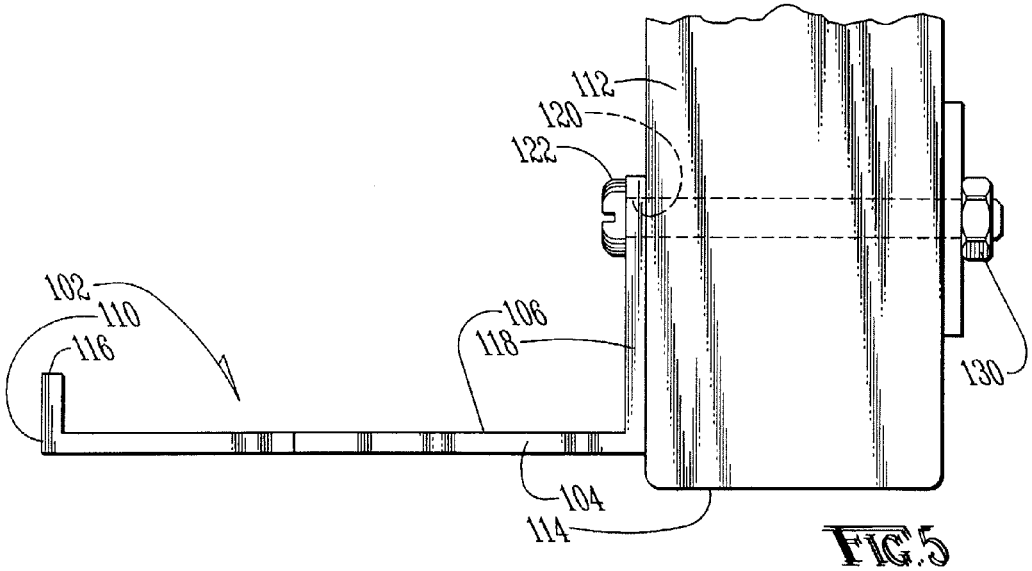
FIG. 5 is a side view of the inventive device with an alternate installation mechanism.

As best shown in FIGS. 5-8 a variety of overall shapes, designs and configurations of the device 102 may be selected to accomplish specific goals. As shown in FIG. 5, a secondary mounting plate 130 may be positioned on the outer side of the door through which the mechanical fastener 122 is positioned and secured. This adds rigidity to the mounted device 102 and eliminates the possibility of the fastener 122 from becoming unintentionally pulled through the door 112 during use. While the use of screws to fasten the device is acceptable, the supplemental mounting plate 130 secured with a threaded bolt and nut eliminates fastener stripping from the door material.

Figure 6:
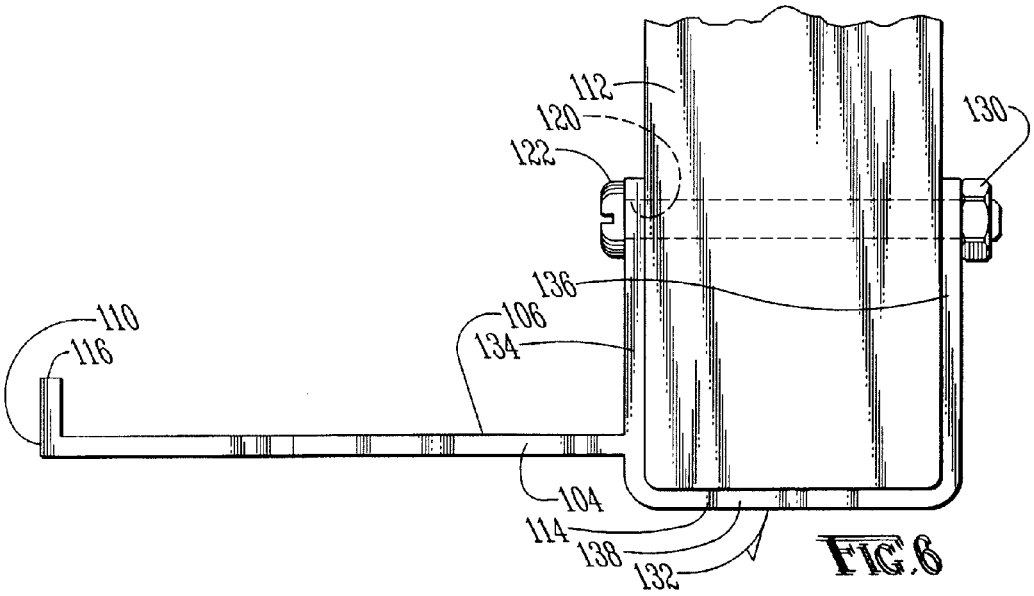
FIG. 6 is side view of another embodiment of the inventive device.

As best shown in FIG. 6, a U-shaped mounting bracket 132 may be formed integrally with the mounting plate 118. This mounting bracket 132 includes integrally formed front mounting plate 134, a rear mounting plate 136 and a bottom cap 138. The fastener 122 is passed through the front mounting plate 134, the door 112 and the rear mounting plate 138. As the fastener 122 is secured, the front mounting plate 134 and rear mounting plate 138 are forced inward to toward the door 112, which substantially stabilizes the device 102 for use. The bottom cap 136 protects the lower edges of the door from damage and adds to the strength and aesthetic appeal of the device 102.

Figure 7:
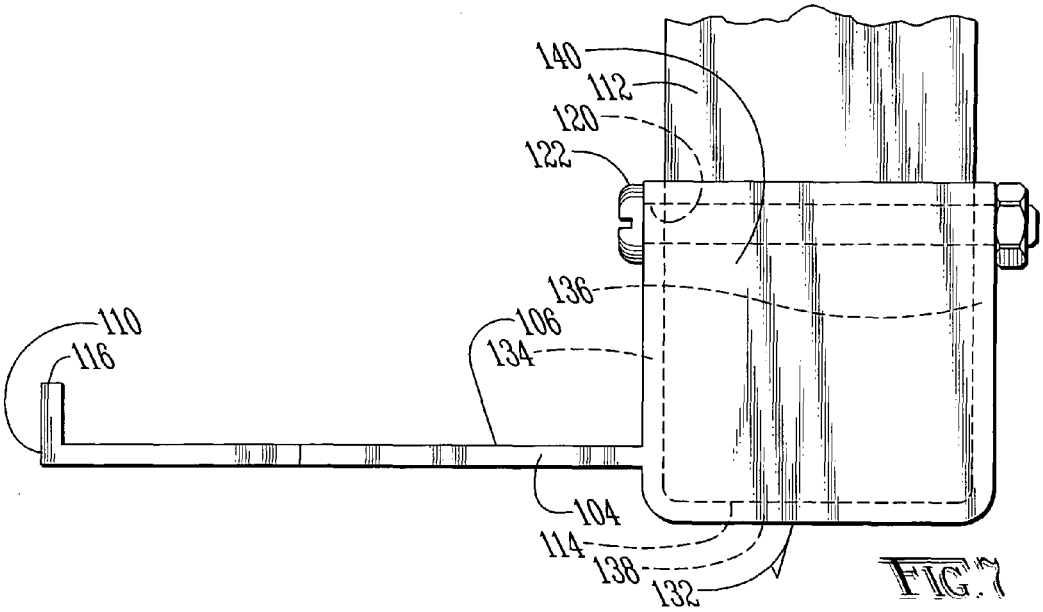
FIG. 7 is a side view of yet another embodiment of the inventive device.
Figure 8:
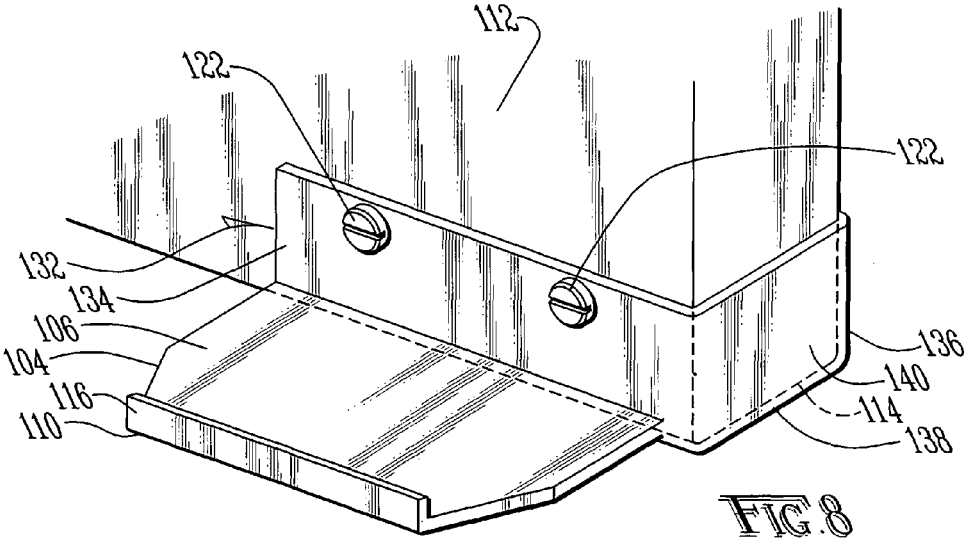
FIG. 8 is a perspective view of the embodiment shown in FIG. 7.
Figure 9:
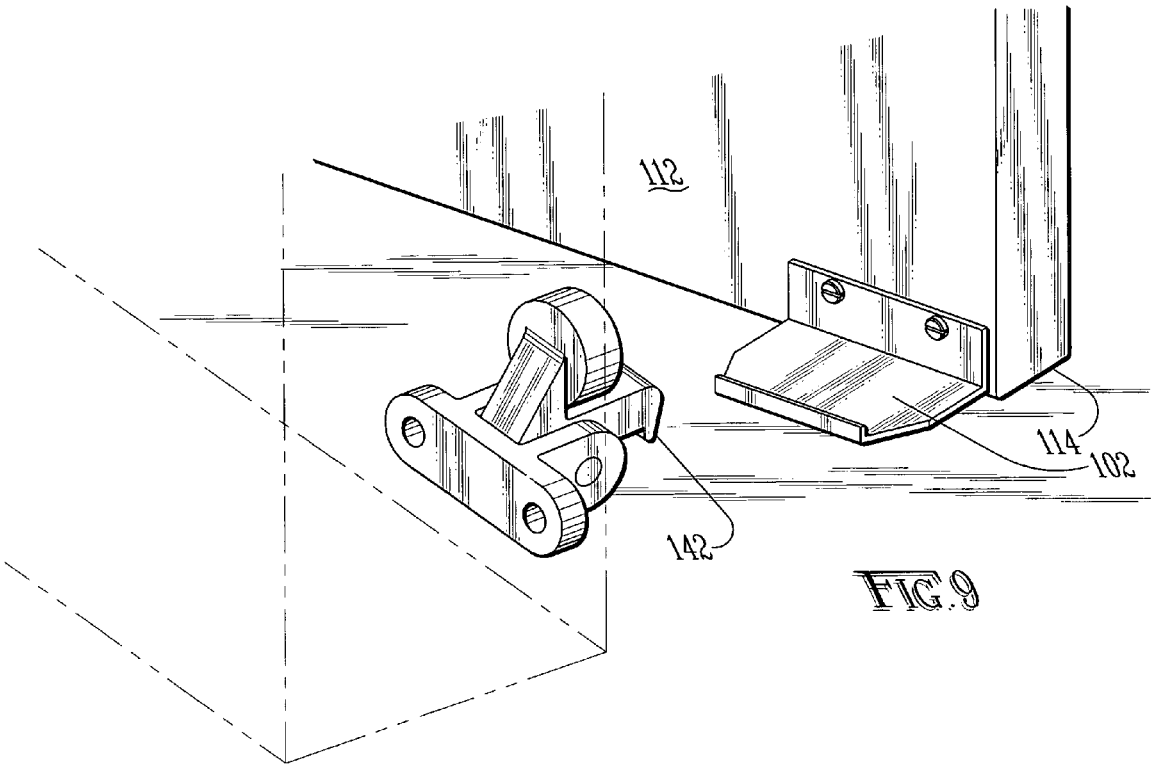
FIG. 9 is a perspective view of the first embodiment of the invention with an associated latch mechanism.

Referring now to FIGS. 7 and 8, an end cap 140 can be integrally formed with the device to connect the front mounting plate 134, rear mounting plate 136 and bottom cap 138 of the U-shaped bracket 132. This end cap 140 further strengthens the device 102, protects the end of the door 112 and adds overall aesthetic appeal.

The inventive door opener 102 can be coupled with a latch mechanism 142 fastened to the floor or a wall near the door 112. When the door 112 is fully opened, the latching mechanism 142 engages the device 102 to hold the door 112 open. It is understood that any conventional latching mechanism could be configured for use with the device 102 and the representative latch is not intended to be limiting but merely illustrative.

It is also a feature of the instant invention that the upper surface 106 is substantially planar and provides a display surface for advertisements and information. Further, any flat surface of the device 102 may be suitable for the display of advertisements or information. For example, in a pub or restaurant, a beverage manufacturer's logo can be placed on the device. A user will spend several seconds during use of the device looking at the upper surface where their foot will be placed.

The foregoing description of the invention is in no way intended to be limiting in scope and it is understood that numerous changes and alterations to the device as described can be made without departing from the spirit and scope of the invention, which is only intended to be limited by the claims appended hereto.

What is claimed is:

1. A door opener to be mounted on an inner surface of an inwardly opening door, comprising:

a mounting plate adapted for attachment to the inner surface of the door, a beam having a first end formed with a bottom portion of the mounting plate and a second end extending away from the mounting plate and substantially perpendicular to the mounting plate, wherein the beam is raised above a bottom edge of the opening door, and a ledge extending upward from the second end of the beam and being angled toward the mounting plate less than perpendicular from the beam;

wherein the mounting plate, the beam and the ledge are formed from a continuous piece of material to produce a unitary door opener.

2. The door opener of claim 1 further comprising an abrasive strip fastened onto an upper surface of the beam to increase the friction between a user's shoe and the upper surface of the beam when the user steps down and pulls back on the beam with a foot wearing the shoe, wherein the upper surface is in a horizontal plane.

3. The door opener of claim 1 wherein the ledge is formed with a profile.

4. The door opener of claim 3 wherein the profile is scalloped.

5. The door opener of claim 1 wherein an upper surface of the beam and the ledge are covered with a gripping material.

6. The door opener of claim 1 wherein the mounting plate includes an integrally formed-U-shaped mounting bracket.

7. The door opener of claim 1 wherein the mounting plate includes an integrally formed front plate, back plate, bottom cap and end cap to substantially encapsulate the lower outermost corner of the door.

8. The door opener of claim 1 further comprising a secondary mounting plate for positioning on the opposite side of the door and through which a mechanical fastener is secured.

9. The door opener of claim 1, wherein the mounting plate comprises at least two mounting holes above the bottom portion of the mounting plate and being substantially aligned with a top edge of the mounting plate.

10. The door opener of claim 1, wherein the beam is tapered toward the second end such that the ledge is narrower than the mounting plate.

11. The door opener of claim 1, wherein the ledge is substantially planar.

12. A door opener for mounting to a hinged door; comprising:

a mounting plate adapted for attachment to the inner surface of the door, a beam substantially perpendicular to the mounting plate and having a first end formed with the mounting plate and a second end projecting generally outward from the mounting plate, wherein the beam is raised above a bottom edge of the hinged door, and a ledge spaced apart from the mounting plate and projecting generally upward from the second end of the beam and being angled toward the mounting plate less than perpendicular from the beam;

wherein the mounting plate, the beam and the ledge are formed from a continuous piece of material to produce a unitary door opener.

13. The door opener of claim 12 further comprising a latch mechanism mounted to a wall near the hinged door, wherein the latch mechanism is removably fastened to the door opener to hold the door in an open position.

* * * * *